US006932192B2

(12) United States Patent
Blythe et al.

(10) Patent No.: US 6,932,192 B2
(45) Date of Patent: Aug. 23, 2005

(54) BOAT STAIRS BRACKET

(75) Inventors: James D. Blythe, Miller Place, NY (US); Robert Devine, Jupiter, FL (US)

(73) Assignee: Chem-Tainer Industries, Inc., West Banylon, NY (US)

( * ) Notice: Subject to any disclaimer, the term of this patent is extended or adjusted under 35 U.S.C. 154(b) by 0 days.

(21) Appl. No.: 10/280,599

(22) Filed: Oct. 25, 2002

(65) Prior Publication Data

US 2004/0079584 A1 Apr. 29, 2004

(51) Int. Cl.[7] ..... E04G 3/00
(52) U.S. Cl. ..... 182/82; 182/97; 292/238
(58) Field of Search ..... 182/82, 20, 91, 182/97; 292/238, 121, 259 R, 33 R; 24/702

(56) References Cited

U.S. PATENT DOCUMENTS

RE29,925 E * 3/1979 McGillivray ..... 292/121
4,451,072 A * 5/1984 Petty, Sr. ..... 292/128
4,467,952 A * 8/1984 Morrell, Jr. ..... 227/123
4,587,695 A * 5/1986 Jensen ..... 24/634
4,809,424 A * 3/1989 Bianchi et al. ..... 29/564.2
4,826,193 A * 5/1989 Davis ..... 280/304.1
4,929,004 A * 5/1990 Chidester ..... 292/267
4,936,611 A * 6/1990 Palvolgyi ..... 292/28
5,104,163 A * 4/1992 Palmer, Jr. et al. ..... 292/335
5,405,114 A * 4/1995 Dias ..... 248/250
5,498,041 A * 3/1996 Bezzerides et al. ..... 292/225
6,190,200 B1 * 2/2001 Burwell ..... 439/557
6,425,612 B1 * 7/2002 Schaeffer ..... 292/341.17
2002/0060460 A1 * 5/2002 DeSouza ..... 292/238

* cited by examiner

*Primary Examiner*—Bruce A. Lev
(74) *Attorney, Agent, or Firm*—Duncan Palmatier

(57) ABSTRACT

A bracket to hold a boarding ladder to a boat. A quick release mechanism for both the ladder and the bracket itself are disclosed. A mounting plate is substantially flush with the side of the boat. The bracket slides down into the mounting plate and latches into place. The bracket accepts the upper bar of a boarding ladder and closes a latch over the bar, holding the ladder in place. To remove the ladder, a latch at the top of the bracket is lifted and the ladder can be easily pulled free. To free the bracket from the mounting plate after the ladder has been removed, the latch is lifted and the bracket can be lifted out.

9 Claims, 6 Drawing Sheets

Fig. 3a
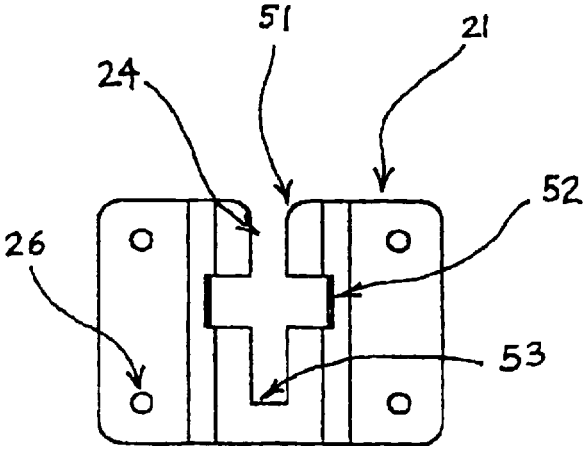
Fig. 3b
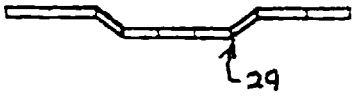
Fig. 3c
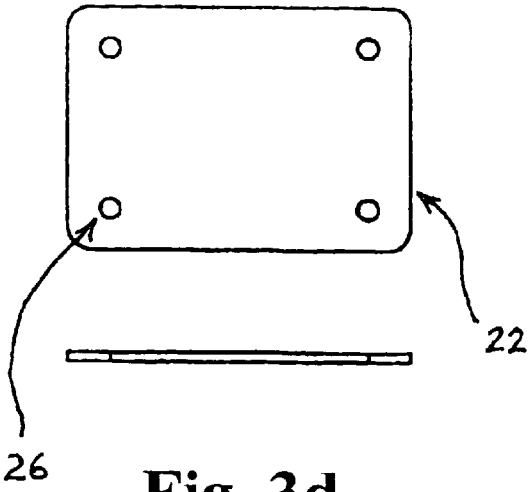
Fig. 3d
Fig. 3e
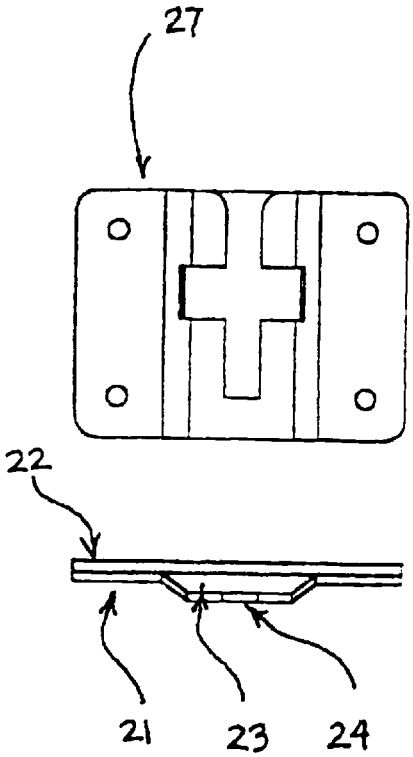
Fig. 3f Fig. 4d
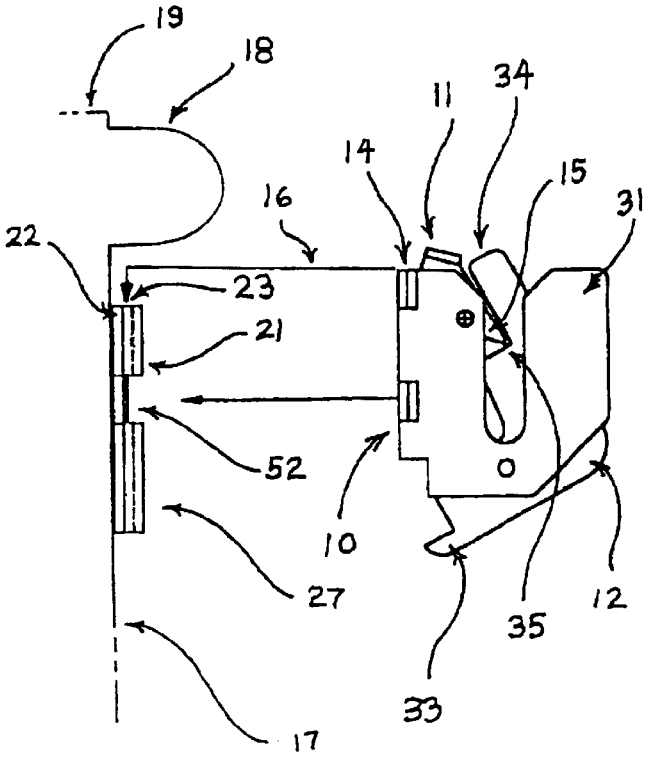
Fig. 4a
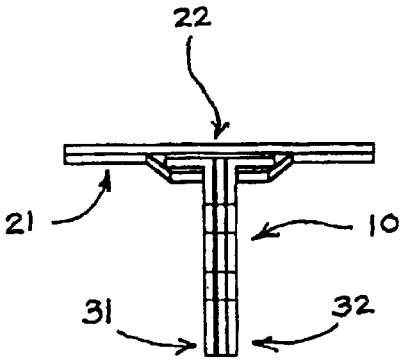
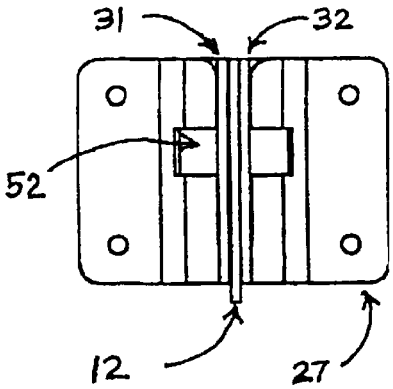
Fig. 4b
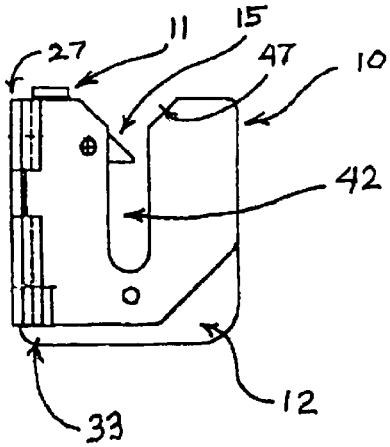
Fig. 4c

BOAT STAIRS BRACKET

The present invention relates to a bracket to hold a boarding stairs to a boat. The invention provides a quick release mechanism for both the stairs and the bracket itself.

BACKGROUND OF THE INVENTION

Boats often provide removable stairs to ease boarding. The stairs are designed to be removed when the boat leaves dock and is underway. Many boarding stairs are mounted to the boat by a bracket. These brackets stick out from the boat and it is desirable to remove the protruding bracket to avoid damaging the bracket and the area of the boat where the bracket is mounted during docking or when coming alongside another boat.

Existing boarding stairs brackets do not provide an easy means to release the stairs. Most conventional boarding stairs have a half-inch steel bar horizontally across the top of the stairs. The bar must be inserted through the stairs and through holes in the mounting bracket, then secured with cotter pins or nuts to keep the bar from sliding out. However, aligning the bar with the holes in the stairs and the bracket, while a boat is rocking in the water by a dock, is a difficult and frustrating endeavor. Moreover, the cotter pins or nuts that secure the bar can be very easily dropped and lost in the harbor water. In addition, many brackets are held to the boat by a mounting plate, allowing removal of the bracket. When the bracket is removed, the mounting plate does not protrude substantially from the boat, thereby avoiding potential damage to the boat when it comes along side a dock or another boat. The mounting plate screws to the side of the boat and is substantially flush. A vertical slot in the mounting plate accepts the bracket and a pin is inserted through a slot in the mounting plate and a hole in the bracket to hold the bracket in place. As with the boarding stairs mounting bar, the pins securing the bracket to the mounting plate are very easily dropped and lost during the removal process. Additionally, the mounting plate's vertical slot for the bracket requires several inches of free space above the mounting plate so the bracket can be dropped in. The bracket must be mounted high on the side of the boat, close to the level of the deck, so that the top stair will not require too great a last step for boarding. However, many boats have lips, rub rails, and other features that extend beyond the side of the boat, making it difficult to locate the mounting plate close to the level of the deck but also provide enough free space above the mounting plate for the bracket to be dropped in. For this reason, boats with such features cannot use releaseable boarding stairs brackets, but must rely on permanently fixed brackets. As noted above, this is undersirable, because the bracket protrudes beyond the side of the boat; the protruding bracket can be torn away during docking or coming alongside another boat, thereby damaging the hull, or it can damage other boats.

SUMMARY OF THE INVENTION

It is one object of the present invention to provide a boarding stairs bracket that provides an easy and quick release mechanism for removal of the stairs. It is another object of the present invention to provide a boarding stairs bracket with an integral latch that does not rely on extra parts, such as pins or nuts, to secure the stairs to the bracket. It is another object of the present invention to provide a boarding stairs bracket that is itself easily and quickly released from the boat. It is another object of the present invention to provide a boarding stairs bracket with an integral latch that does not rely on extra parts, such as pins, to secure the bracket to the boat. It is another object of the present invention to provide a boarding stairs bracket that allows removal of the bracket from the mounting plate without requiring much, if any, free space above the mounting plate.

In accordance with these objectives, the present invention provides a quick release mechanism for both the stairs and the bracket itself. A mounting plate is substantially flush with the side of the boat. The bracket slides down into the mounting plate and latches into place. The bracket accepts the upper bar of a boarding stairs in a slot, and a latch closes over the bar, holding the stairs in place. To remove the stairs, the latch at the top of the bracket is pivoted and the stairs can be easily and quickly lifted free. With the latch pivoted to the open position and the stairs removed, the bracket can be easily and quickly lifted from the mounting plate. The mounting plate has openings and the bracket has corresponding tabs so that the bracket can be inserted horizontally into the mounting plate then dropped and latched into place. This design s effectively eliminates the need for free space above the mounting plate for insertion of the bracket.

BRIEF DESCRIPTION OF THE DRAWINGS

FIG. 3*a* is a front view of the front plate of the mounting plate. FIG. 3*b* is a top view of the front plate of the mounting plate. FIG. 3*c* is a front view of the back plate of the mounting plate. FIG. 3*d* is a top view of the back plate of the mounting plate. FIG. 3*e* is a front view of the mounting plate assembly. FIG. 3*f* is a top view of the mounting plate assembly.

FIG. 4*a* is a top view of the bracket and mounting plate assembly. FIG. 4*b* is a front view of the bracket and mounting plate assembly. FIG. 4*c* is a side view of the bracket and mounting plate assembly, showing the latches in the locked position. FIG. 4*d* is a side view of the bracket and mounting plate assembly mounted to a boat just below a rub rail, showing the latches in the open position, and showing the bracket separated from the mounting plate.

DESCRIPTION

Figure 1:
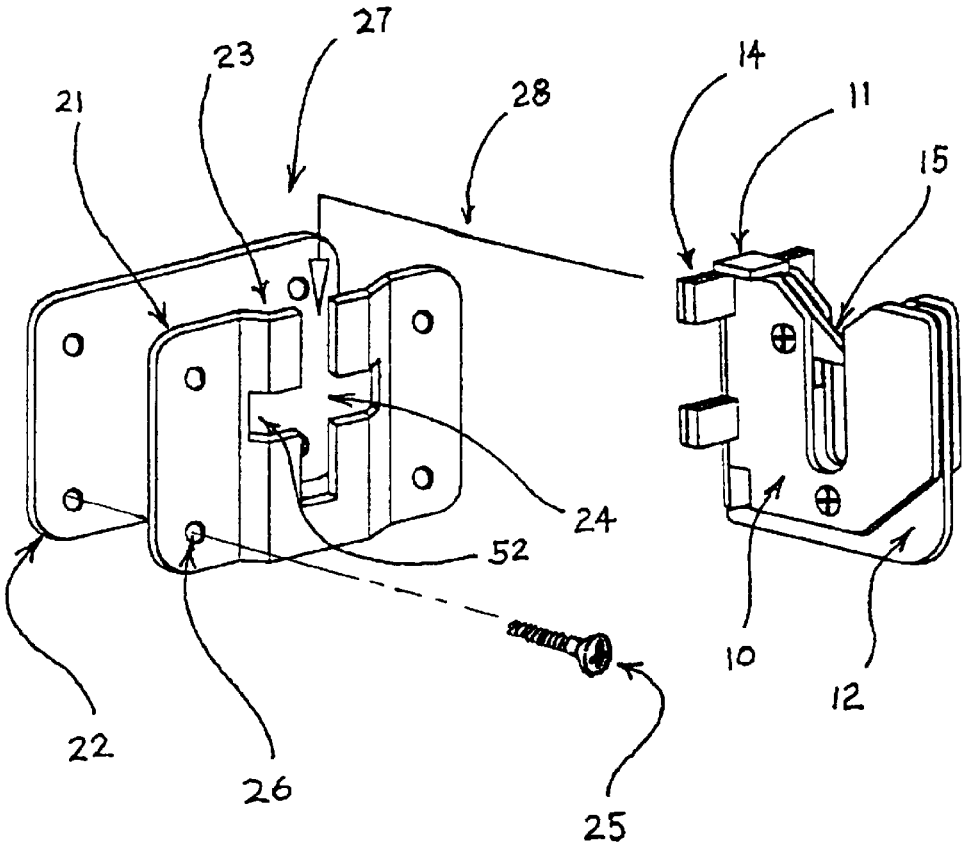
FIG. 1 is a perspective view of the bracket and an exploded view of the mounting plate.

FIG. 1 shows the bracket assembly 10 and an exploded view of the mounting plate 27. The bracket 10 has tabs 14 on its back surface. A cross slot 52 in the opening 24 forms a chamber 23 between the front 21 and rear 22 plates of the mounting plate assembly 27. Holes 26 in the mounting plate 27 accept screws 25 to fasten the mounting plate 27 to a boat (not shown). As indicated by arrow 28, the tabs 14 on the back of the bracket 10 allow the bracket 10 to be inserted horizontally into the chamber 23 of the mounting plate 27, then the bracket 10 drops into place. As more fully described below, a top latch 11 can be pivoted, dropping a finger 15, allowing a bottom latch 12 to pivot, thereby permitting the bracket 10 to be inserted or removed from the mounting plate 27.

Figure 2:
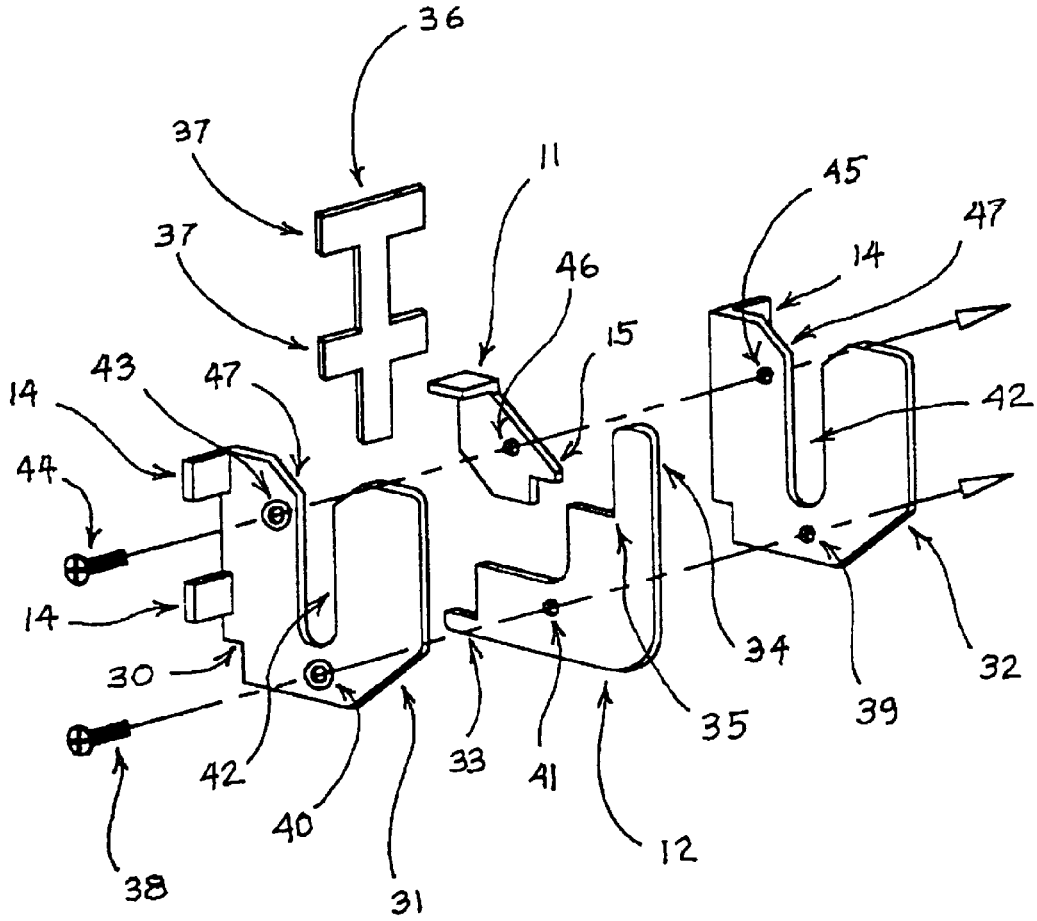
FIG. 2 is an exploded view of the bracket.
Figure 5A:
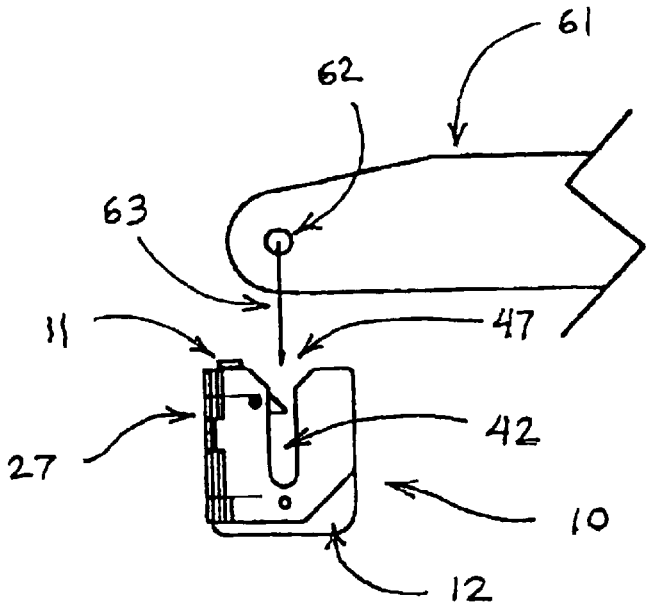
FIGS. 5*a, b* and *c* show the steps of dropping the boarding stairs into the bracket.

FIG. 2 shows an exploded view of the parts of the bracket 10. Sides 31 and 32 have tabs 14 that align with corresponding tabs 37 on a back plate 36. The sides 31 and 32 are joined to the back plate 36 by any conventional means, such as welding or securing the parts with fasteners, such as screws. Alternatively, the sides 31 and 32 and he back plate 36 can be manufactured as a single piece by a molding or machining process. The sides 31 and 32 sandwich latches 11 and 12. Top latch 11 pivots on a screw 44. The screw 44 extends through a hole 43 in side plate 31, through a pivot hole 46 in latch 11, and is received by threaded hole 45 in side plate 32. Bottom latch 12 pivots on a screw 38. The screw 38 extends through a hole 40 in side plate 31, through the pivot hole 41 in latch 12, and is received by threaded hole 39 in side plate 32. Screws 44 and 38 may be permanently secured in side plate 32 by welding or riveting. Those skilled in the art will appreciate that screws 44 and 38 may be substituted by any appropriate axle, such as rivets or pins or the like, for the top 11 and bottom 12 latches. Top latch 11 has a finger 15. Bottom latch 12 has a step 35, a top finger 34, and a bottom finger 33. As seen in FIG. 4*c*, a slot 42 in the bracket 10 can receive a boarding stairs bar (62, as seen in FIGS. 5 and 6). FIG. 4*c* shows the top 11 and bottom 12 latches in the closed position, with top latch finger 15 across the top of the slot 42, barring beveled opening 47 of the slot 42, and bottom latch finger 33 extending horizontally across and out from the bottom of the bracket, locking the bracket 10 at the bottom of the mounting plate 27. FIG. 4*d* shows the top 11 and bottom 12 latches in the position allowing the bracket 10 to be inserted into or freed from the mounting plate 27. FIG. 4*d* shows that the bracket can be releaseably mounted to the boat immediately below a rub rail 18. The mounting plate 27 is shown screwed to a boat's hull 17, almost immediately below a rub rail 18, which is adjacent the deck 19. Arrow 16 shows that the bracket 10 may be inserted into the mounting plate 27 horizontally. The lower tab 14 fits into the cross opening 52 of the mounting plate opening, and the bracket 10 can then drop into the chamber 23 and rest on the seat (53, as seen in FIG. 3*a*). With this arrangement, it is possible to mount the bracket almost immediately the rub rail 18, which allows the boarding stairs to be mounted high enough so that the top stair is an easy step to the deck 19. To remove the bracket 10, top latch 11 is pivoted forward and finger 15 is allowed to pivot inward. Without the stairs mounting bar (62, as seen in FIGS. 5 and 6) in the slot 42, bottom latch 12 can pivot inward, dipping step 35 to receive the finger 15 of the top latch 11. In turn, bottom finger 33 pivots down and away, allowing the bracket 10 to be lifted and pulled out from the mounting plate 27. In the preferred embodiment disclosed here, the top 11 and bottom 12 latches cooperate; that is, the step 35 in bottom latch 12 provides a stop for the top 11 and bottom 12 latches. However, after considering the invention disclosed here, those skilled in the art will appreciate that many other latch designs can be employed which fall within the scope of the invention. For example, top 11 and bottom 12 latches could be operated independent of each other, or a single latch could secure both the boarding stairs mounting bar (62, as seen in FIGS. 5 and 6) and the bracket 10. With respect to the latter, while such a latch design is a contemplated embodiment of the invention, the preferred embodiment shown has the advantage of preventing the bracket 10 from being inadvertently pulled out of the mounting plate 27 when the boarding stairs mounting bar (62, as seen in FIGS. 5 and 6) is lifted free.

FIGS. 3*a–f* show the mounting bracket. Front plate 21 has a chamber portion 29 with an opening 24. A cross opening 52 gives the opening 24 a cross shape. The front plate 21 is mated with a back plate 22 to form the mounting plate assembly 27. When the front plate 21 is mounted to the back plate 22, the chamber portion 29 forms a chamber 23. Holes 26 in the plates 21 and 22 allow the mounting plate 27 to be secured to a boat (not shown) with any suitable fasteners, such as screws (25, as seen in FIG. 1). It will be appreciated that, when mounted to a boat, the back plate 22 is not needed for securing the bracket 10 in the mounting plate chamber 29. However, the back plate 22 keeps the bracket 10 from rubbing against and damaging the boat. It will also be appreciated that the back 22 and front 21 plates forming the mounting plate assembly 27 can be manufactured as a single piece by molding or machining. Additionally, the back plate 22 of the mounting bracket 27 need not form a solid piece; it is sufficient that if a back portion is incorporated it separates the bracket 10 from the boat. A bevel 51 at the top of the opening 24 eases insertion of the bracket (10, as seen in FIG. 1). As shown in FIG. 1, the tabs 14 on the back of the bracket 10 allow it to be first inserted horizontally into the cross openings 52 of the mounting plate 27, then dropped vertically in the opening 24 where the notch (30, as seen in FIG. 2) in the bracket 10 rests on the seat 53 at the bottom of the opening 24 of the mounting plate 27. The tabs 14 and cross openings 52 make it possible to insert the bracket 10 horizontally into the mounting plate 27, thereby substantially reducing the free space needed above the mounting plate 27 for vertical insertion. It will be appreciated by those skilled in the art that the beveled opening 51 of the mounting bracket 27 could be shaped to form a cross opening, which would allow the upper tab 14 to be inserted horizontally into the mounting plate 27 without the need for any free space above it.

Figure 5B:
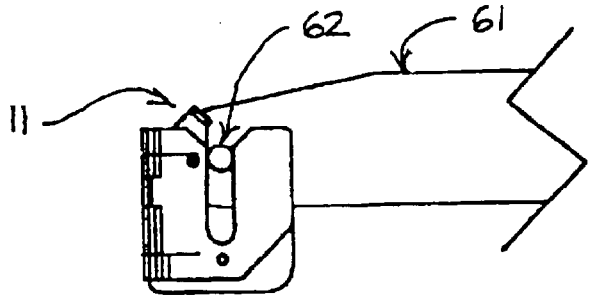
Figure 5C:
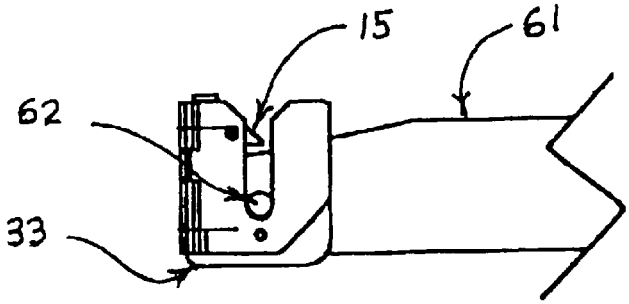
Figure 6A:
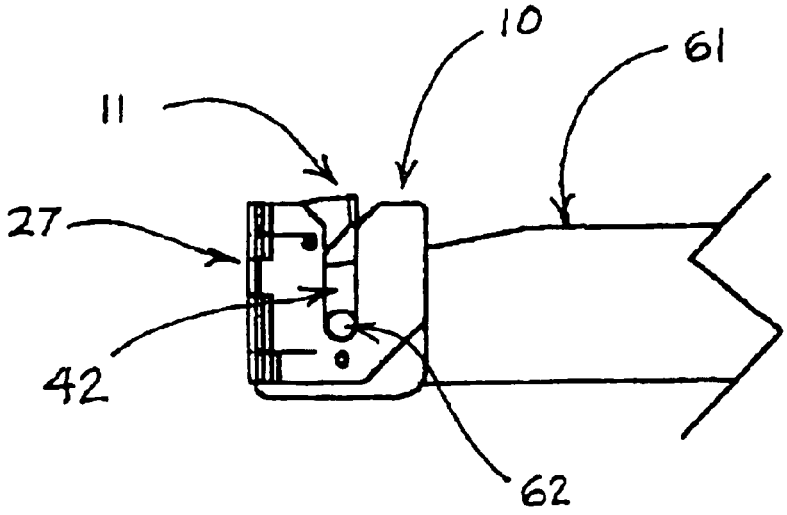
FIGS. 6*a* and *b* show the steps of pulling the boarding stairs up and out of the bracket.
Figure 6B:
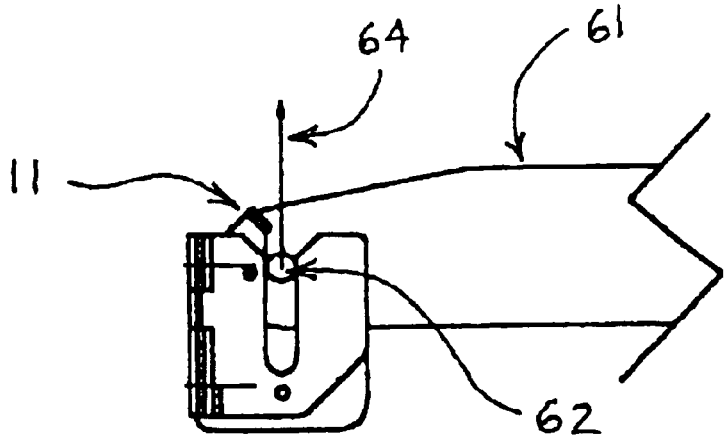

FIGS. 5*a–c* and 6*a–b* show the boarding stairs mounting and releasing processes. The top frame of a boarding stair 61 has a bar 62 that extends out from the frame 61. As indicated by arrow 63 in FIG. 5*a*, the bar 62 is dropped into the beveled opening 47 of the bracket slot 42. FIG. 5*b* shows that the bar 62 pushes down the finger (15, as seen in FIG. 5*c*), which pivots the top latch 11. FIG. 5*c* shows that the bar 62 comes to a rest at the bottom of the slot 42, and the top latch can be pivoted back up, where finger 15 keeps the bar 62 in the bracket slot 42, thereby securing the boarding stairs. It will be appreciated that, when the boarding stairs are in place, the bar 62 keeps the bottom latch 12 from pivoting, thereby locking the bracket 10 to the mounting plate 27. FIGS. 6*a* and *b* show the process of removing the boarding stairs from the bracket 10. The top latch 11 is pivoted inward so that the finger 15 swivels down and back to clear the slot 42. The boarding stairs 61 are lifted up and out of the slot 42. As the bar 62 passes the top latch 11, it pushes the latch 11 back up as it passes.

As discussed above, the mounting bracket 27 and bracket's sides, 31 and 32, and back 36 can be manufactured by assembling them from separate parts, but those skilled in the art will appreciate that they can be molded or machined or otherwise fabricated as single pieces. It will also be appreciated that the top 11 and bottom 12 latches incorporated into the bracket 10 could be incorporated into the mounting plate 27. Because the bracket 10 and mounting plate 27 are intended for marine use, it is preferable to construct them out of non-corrosive materials, such as aluminum, stainless steel, plastics, or other similar materials.

The drawings and description set forth here represent only some embodiments of the invention. After considering these, skilled persons will understand that there are many ways to make a boarding stairs bracket according to the principles disclosed. The inventors contemplate that the use of alternative structures, materials, or manufacturing techniques, which result in a boarding stairs bracket according to the principles disclosed, will be within the scope of the invention.

We claim:

1. A boarding stairs bracket assembly, comprising:

a mounting plate having a back portion for mounting the plate to a boat, a front portion, a top portion and a bottom portion, a chamber, a top opening in the top portion that communicates with the chamber, and a front opening with a top opening that opens at the top portion and a bottom stop and at least one cross opening, wherein the front opening also communicates with the chamber, and a bracket comprising sides, a seat and a back portion, wherein the back portion further comprises at least one tab sized to be received by the cross opening in the front opening of the mounting plate, and wherein the back portion is sized to be received through the top and front openings and into the chamber of the mounting plate, and wherein the seat rests on the bottom stop of the plate, and wherein the sides of the bracket further comprise a slot with a slot opening to receive a mounting bar of a boarding stairs, and wherein the bracket further comprises a top latch releaseably keeping the bar in the slot, and a bottom latch releaseably securing the bracket to the bottom portion of the mounting bracket.

2. The boarding stairs bracket assembly of claim 1 wherein the top latch comprises a lifting tab and a bar extending across slot opening to keep the boarding stairs mounting bar in the slot.

3. The boarding stairs bracket assembly of claim 1 wherein the bottom latch further comprises a finger extending from the bracket and under the bottom portion of the mounting plate, thereby locking the bracket to the plate.

4. The boarding stairs bracket assembly of claim 3 wherein the bottom latch further comprises an extension sized to extend along the mounting bar slot when the finger is under the bottom portion of the plate locking the bracket to the plate.

5. Boat boarding stairs and attachment assembly, comprising boarding stairs;

a mounting plate having a chamber and an opening communicating with the chamber, and a bracket comprising a back portion sized to be received through the opening and into the chamber of the mounting plate, a slot to receive a mounting bar of the boarding stairs, and a top latch releaseably keeping the bar in the slot.

6. The boarding stairs attachment assembly of claim 5 further comprising a bottom latch securing the bracket to the mounting plate.

7. The boarding stairs attachment assembly of claim 5 wherein the mounting plate further comprises a front portion, and wherein the opening is in the front portion of the mounting plate, and wherein the opening further comprises a tab opening and a bottom and a stop at the bottom, and wherein the back portion of the bracket further comprises a seat and a tab sized to be received by the tab opening, and wherein the seat rests on the stop.

8. Boarding stairs and attachment assembly, comprising boarding stairs;

a side portion, a vertical slot in the side portion sized to receive a mounting bar of the boarding stairs, wherein the boarding stairs mounting bar is lowered vertically into the slot, and a latch releaseably keeping the bar in the slot.

9. The boarding stairs attachment assembly of claim 8 wherein the latch comprises a lifting tab and a bar extending across the slot to keep the boarding stairs mounting bar in the slot.

* * * * *